US006756943B2

(12) United States Patent
Kim et al.

(10) Patent No.: US 6,756,943 B2
(45) Date of Patent: Jun. 29, 2004

(54) RETRACTABLE/EXTENDABLE ANTENNA UNIT HAVING A CONDUCTIVE TUBE IN A PORTABLE RADIOPHONE

(75) Inventors: Jong-Goo Kim, Yongin-shi (KR); Seong-Beom Hong, Cheju-shi (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 10/090,581

(22) Filed: Mar. 4, 2002

(65) Prior Publication Data

US 2002/0135533 A1 Sep. 26, 2002

(30) Foreign Application Priority Data

Mar. 24, 2001 (KR) ..... 2001/15495

(51) Int. Cl.[7] ..... H01Q 1/24
(52) U.S. Cl. ..... 343/702; 343/895
(58) Field of Search ..... 343/702, 895, 343/900, 901

(56) References Cited

U.S. PATENT DOCUMENTS

| | | | | | |
|---|---|---|---|---|---|
| 5,353,036 | A | * | 10/1994 | Baldry | 343/702 |
| 5,446,469 | A | * | 8/1995 | Makino | 343/702 |
| 5,479,178 | A | * | 12/1995 | Ha | 343/702 |
| 5,734,351 | A | * | 3/1998 | Ojantakanen et al. | 343/702 |
| 5,764,191 | A | * | 6/1998 | Tsuda | 343/702 |
| 6,052,089 | A | * | 4/2000 | Eggleston | 343/702 |
| 6,069,592 | A | * | 5/2000 | Wass | 343/895 |
| 6,121,930 | A | | 9/2000 | Grangeat et al. | |
| 6,218,991 | B1 | | 4/2001 | Sanad | |
| 6,239,768 | B1 | * | 5/2001 | Oh et al. | 343/895 |
| 6,288,681 | B1 | * | 9/2001 | Kim et al. | 343/702 |
| 6,369,764 | B1 | * | 4/2002 | Ishikawa | 343/702 |
| 6,414,638 | B1 | * | 7/2002 | Egashira | 343/702 |
| 6,476,768 | B2 | * | 11/2002 | Woo et al. | 343/702 |
| 6,498,586 | B2 | | 12/2002 | Pankinaho | |

FOREIGN PATENT DOCUMENTS

| | | |
|---|---|---|
| DE | 199 29 689 A1 | 1/2001 |
| EP | 0 986 131 A2 | 3/2000 |
| EP | 0 997 967 A1 | 5/2000 |

* cited by examiner

*Primary Examiner*—Tan Ho
(74) *Attorney, Agent, or Firm*—Dilworth & Barrese LLP

(57) ABSTRACT

A retractable/extendable antenna unit having a conductive tube for a mobile communication terminal with improved communication performance by means of an elongated rod antenna of a whip antenna in its extended position. The antenna unit has an antenna housing extending from a main body of the terminal, provided with an helical antenna; a whip antenna disposed retractably or extendably with respect to the antenna housing, having in its one end an insulator having a length shorter than that of the helical antenna and in its other end a rod antenna; and a conductive tube disposed in a longitudinal direction of the main body, for receiving the rod antenna. The insulator is positioned within the helical antenna when the whip antenna is fully retracted into the antenna housing. The antenna unit improves antenna performance and decreases SAR.

7 Claims, 8 Drawing Sheets

RETRACTABLE/EXTENDABLE ANTENNA UNIT HAVING A CONDUCTIVE TUBE IN A PORTABLE RADIOPHONE

CLAIM OF PRIORITY

This application makes reference to, incorporates the same herein, and claims all benefits accruing under 35 U.S.C. §119 from an application entitled *Retractable/Extendable Antenna Unit Having Conductive Tube For Portable Radiophone* earlier filed in the Korean Industrial Property Office on Mar. 24, 2001 and thereby duly assigned Ser. No. 15495/2001 by the Office.

BACKGROUND OF THE INVENTION

1. Field of the Invention

The present invention relates to an antenna unit for a portable radiotelephone (terminal) in a mobile communications system and, in particular, to an antenna unit having a conductive tube disposed in a main body of the portable radiotelephone.

2. Description of the Related Art

In general, portable radiotelephones, i.e., mobile communications terminals, which are alternatively referred to as "mobile stations", serve to communicate with one or more "base stations" by radio to provide their end-users with desired radio telecommunications services. Therefore, by means of these mobile terminals, the subscribed users can be served with a diversity of radio telecommunications services such as telephone calling, e-mail transferring, or internet chatting, etc. Usually, such a mobile communications terminal is provided with at least one antenna unit for receiving and transmitting radio signals in its main body. Recently, a retractable/extendable type of antenna unit has been in wider use to ensure better sensitivity of reception for radio signals.

One of known antenna devices for the mobile communications terminals is illustrated in FIGS. 1 and 2, and consists of a conventional helical antenna and a whip antenna adapted to be retractable into or extendable from an antenna housing. FIG. 1 illustrates the mobile terminal with such a whip antenna 14 (seen extended in FIG. 2) fully retracted into the antenna housing 12, while FIG. 2 illustrates the mobile terminal with the whip antenna 14 fully extended from the antenna housing 12. Accordingly, in case the sensitivity of reception in the antenna goes down, a user may have the whip antenna 14 fully extended out of the antenna housing 12 when using of the mobile terminal. The helical antenna (not shown) is generally positioned within the antenna housing 12 in its longitudinal direction, and when the whip antenna is in a fully retracted position, a rod antenna section 14*c* is received by an insulating tube 16 disposed in the main body 10. The rod antenna section 14*c* is provided with an insulator 14*b* for electrical isolation from the helical antenna and also provided with an antenna cap 14*a* in its uppermost end. The above figures respectively illustrate the main body 10 of a mobile terminal with its battery pack for power supply removed, wherein reference numeral 10*a* indicates a bottom surface of the main body.

Referring to FIGS. 3 and 4, the structure and performance of a known antenna unit consisting of a helical antenna (not shown), disposed within an antenna housing 12, and a whip antenna 14 will be described hereinafter. When the whip antenna 14 is in a fully retracted position into the antenna housing, the helical antenna functions as a main antenna. When the whip antenna 14 is in a fully extended position out of the antenna housing, the whip antenna functions as a main antenna. The antenna housing 12 is provided in its lower end with a metal coupling 12*a*, which is preferably formed in one body with the antenna housing 12 and then screwed to the main body for attachment thereto. To the coupling 12*a* is coupled the rod antenna section 14*c*, a lower end of which is further coupled to a stopper 14*d*, forming an electrical feeder.

The rod antenna section 14*c* is received by the insulating tube 16 in a retracted position of the whip antenna 14, while the rod antenna section is separated from the insulating tube in an extended position of the whip antenna. This insulating tube is generally disposed in a longitudinal direction adjacent to a bottom surface 10*a* of the main body, so that it could ensure smooth movement of the whip antenna 14 there through or exclude any physical intervention by any other neighboring elements.

Such a prior art antenna unit usually has a length C1 of an insulator 14*b* much longer than a length C3 of a helical antenna, in order to ensure that the insulator 14*b* can keep better isolation between the helical antenna and the whip antenna.

When the whip antenna 14 is in a fully retracted position in the antenna housing 12, any insufficient or incomplete isolation between the whip antenna and the helical antenna is apt to cause the helical antenna to provide low radiation efficiency due to absorption of its radiation energy by the whip antenna. Further, it would also cause a considerable degradation of the reception efficiency for radio signals due to a reduction in a signal-to-noise ratio at a receiver, since the receiver circuit is often affected by noises induced by any harmonic components of digital clocks generated within a mobile radiotelephone itself.

Accordingly, prior art antenna units in general have been designed to have a length C1 of the insulator of whip antenna much longer than a length C3 of the helical antenna. Considering the length C1 of the insulator, a length C2 of the rod antenna section becomes shorter relatively.

However, the prior art antenna units, which are mostly designed to have a length C1 of the insulator much longer than a length C3 of the helical antenna and to have a shorter length C2 of the rod antenna relatively, often give rise to a problem of degraded antenna efficiency for radio signals, since the rod antenna section 14*a* substantially functions as an operating antenna in an extended position of the whip antenna 14. Furthermore, portable mobile communications terminals are recently being trended toward much smaller size due to striking innovations and improvements in manufacturing technology of hardware components as well as accruing from the users' ever increasing needs for compactness. Therefore, as the size of a main body of the mobile communications terminal is getting smaller and smaller, its antenna unit is also required to have a shorter length. As a result, such a shorter length of antenna unit may lead to a decrease of communication performance in the mobile communications terminal and also cause its user to be more strongly affected by radiation of probably harmful electromagnetic waves upon using of it.

SUMMARY OF THE INVENTION

It is, therefore, an object of the present invention to provide an antenna unit with improved communication performance by increasing its radiation efficiency by means of an elongated rod antenna of a whip antenna in its extended position.

It is another object of the present invention to provide an antenna unit capable of providing a decreased Specific Absorption Rate (SAR), which is referred to as one of the technical criteria for measurement of electromagnetic factors harmful to a human body, proposed in "IEEE (C95.1)/FCC (P.24) safety specification to radio radiation", by means of dispersing the radiation distribution of electromagnetic waves from the antenna unit.

Accordingly, to achieve the above objects of the present invention, an antenna unit for a mobile communications terminal includes an antenna housing extending from a predetermined position on a main body of the mobile communications terminal, the antenna housing having therein an helical antenna; a whip antenna disposed retractably or extendably with respect to the antenna housing, having in its one end an insulator with a length shorter than that of the helical antenna and in its other end a rod antenna; and a conductive tube disposed in a longitudinal direction of the main body under the antenna housing, for receiving the rod antenna in the retracted or extended position of the whip antenna, whereby the insulator is positioned within the helical antenna when the whip antenna is fully retracted into the antenna housing.

Preferably, the conductive tube is made of a metal component. The conductive tube further includes an insulating tube on its inner surface for isolation from the whip antenna. The insulating tube is disposed to extend along said conductive tube, wherein one end of the insulating tube is disposed to protrude in a longitudinal direction from a corresponding one end of the conductive tube, and a diameter of the other end of the insulating tube is made to downwardly decrease within a corresponding other end of the conductive tube. A length of the rod antenna is longer than that of the insulating tube, while a length of the insulator is shorter than that of said helical antenna.

BRIEF DESCRIPTION OF THE DRAWING

The foregoing and other features and advantages of the invention will be apparent from the following more detailed description of preferred embodiments as illustrated in the accompanying drawings, wherein same reference characters refer to the same parts or components throughout the various views. The drawings are not necessarily to scale, but the emphasis instead is placed upon illustrating the principles of the invention, wherein.

DETAILED DESCRIPTION OF THE PREFERRED EMBODIMENTS

In the following description, for purposes of explanation rather than limitation, specific details are set forth such as the particular architecture, interfaces, techniques, etc., in order to provide a thorough understanding of the present invention. However, it will be apparent to those skilled in the art that the present invention may be practiced in other embodiments, which depart from these specific details. For the purpose of simplicity and clarity, detailed descriptions of well-known devices and methods are omitted so as not to obscure the description of the present invention with unnecessary detail.

Figure 1:
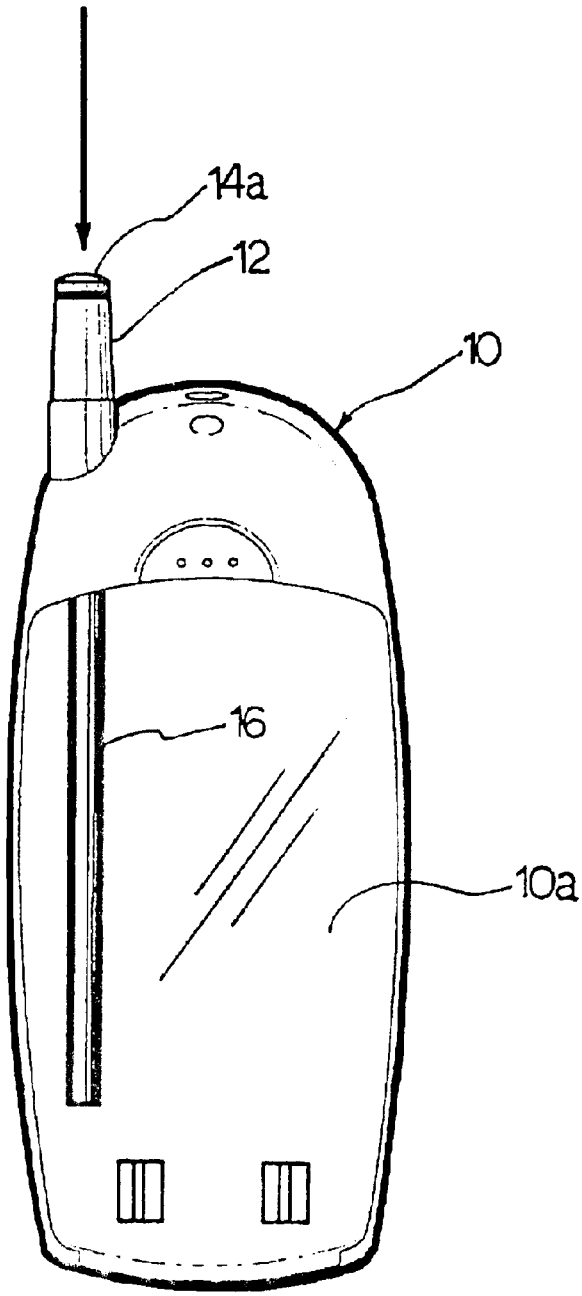
FIG. 1 PRIOR ART
FIG. 1 illustrates a plan view of a bottom surface of a conventional mobile communications terminal with its whip antenna fully retracted.
Figure 2:
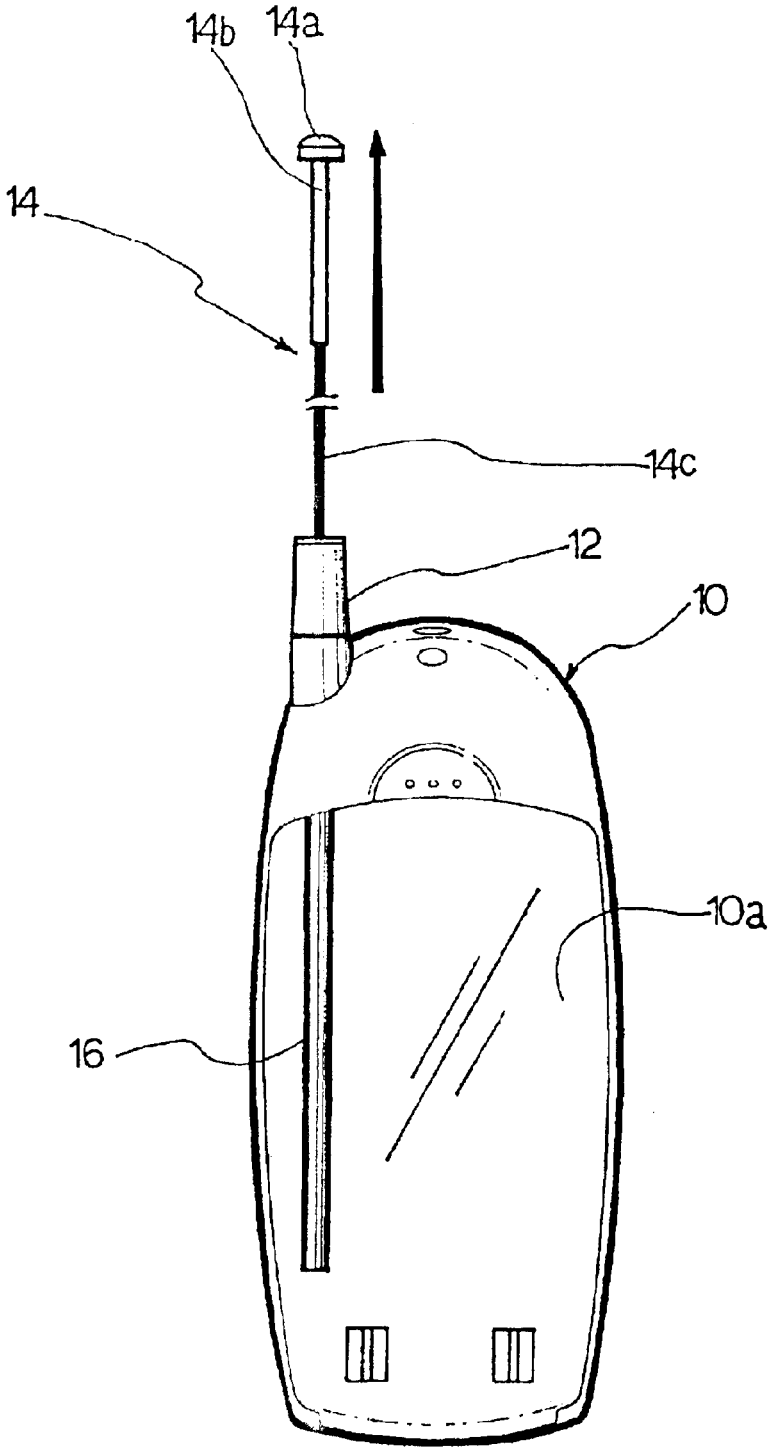
FIG. 2 PRIOR ART
FIG. 2 illustrates a plan view of the bottom surface of the conventional mobile communications terminal with its whip antenna fully extended.
Figure 3:
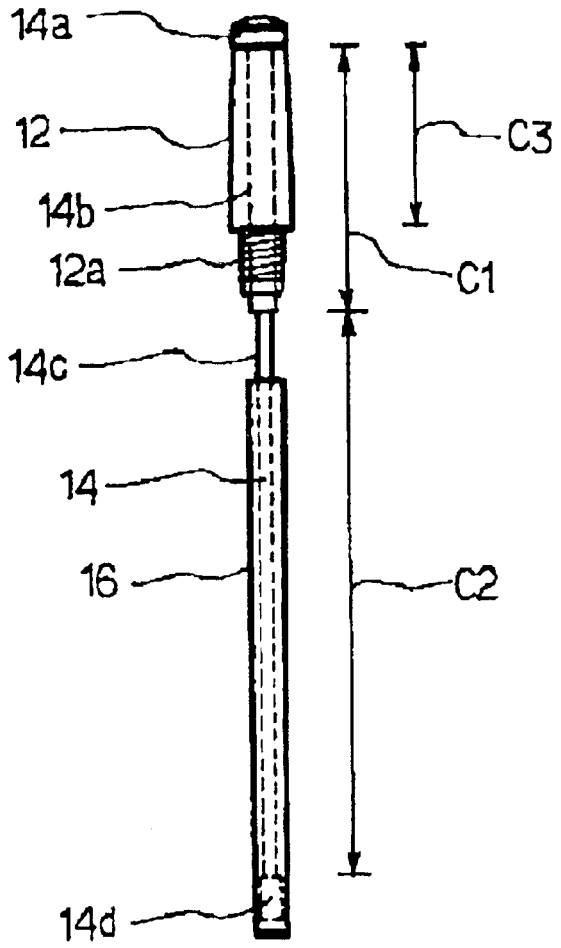
FIG. 3 PRIOR ART
FIG. 3 illustrates a schematic diagram of a structure of a prior art antenna unit with its whip antenna fully retracted.
Figure 4:
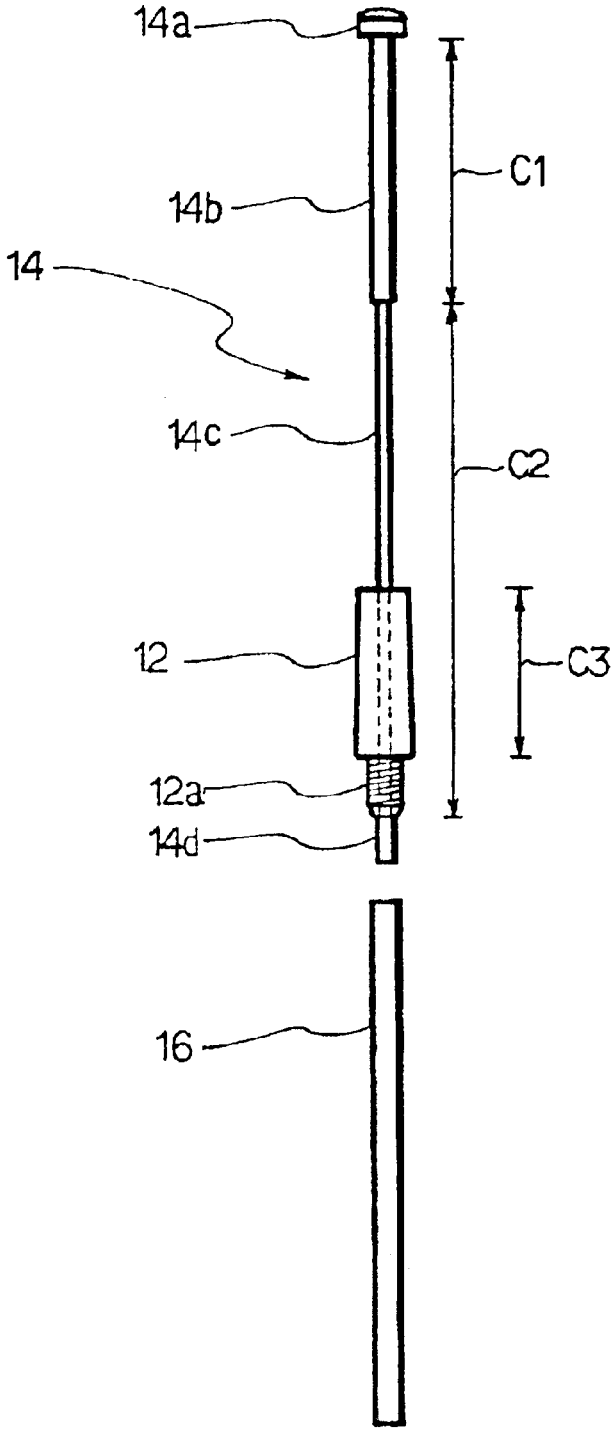
FIG. 4 PRIOR ART
FIG. 4 illustrates a schematic diagram of a structure of a prior art antenna unit with its whip antenna fully extended.
Figure 5:
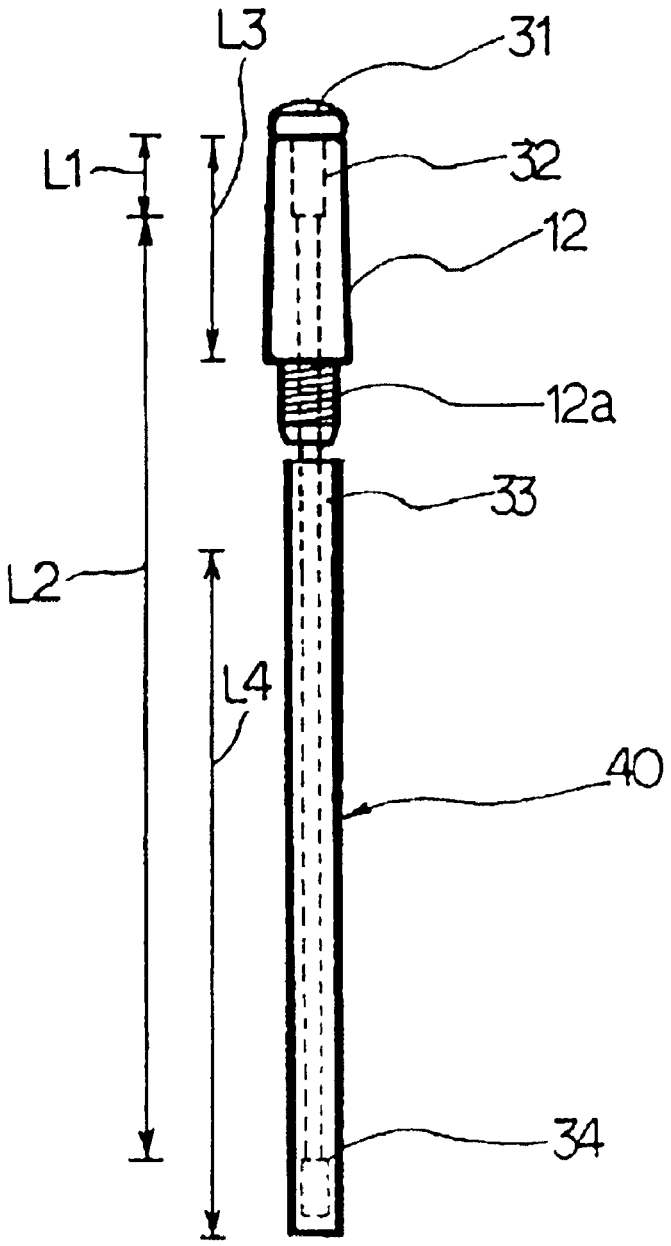
FIG. 5 illustrates a schematic diagram of a structure of an antenna unit according to a preferred embodiment of the present invention with its whip antenna fully retracted.
Figure 6:
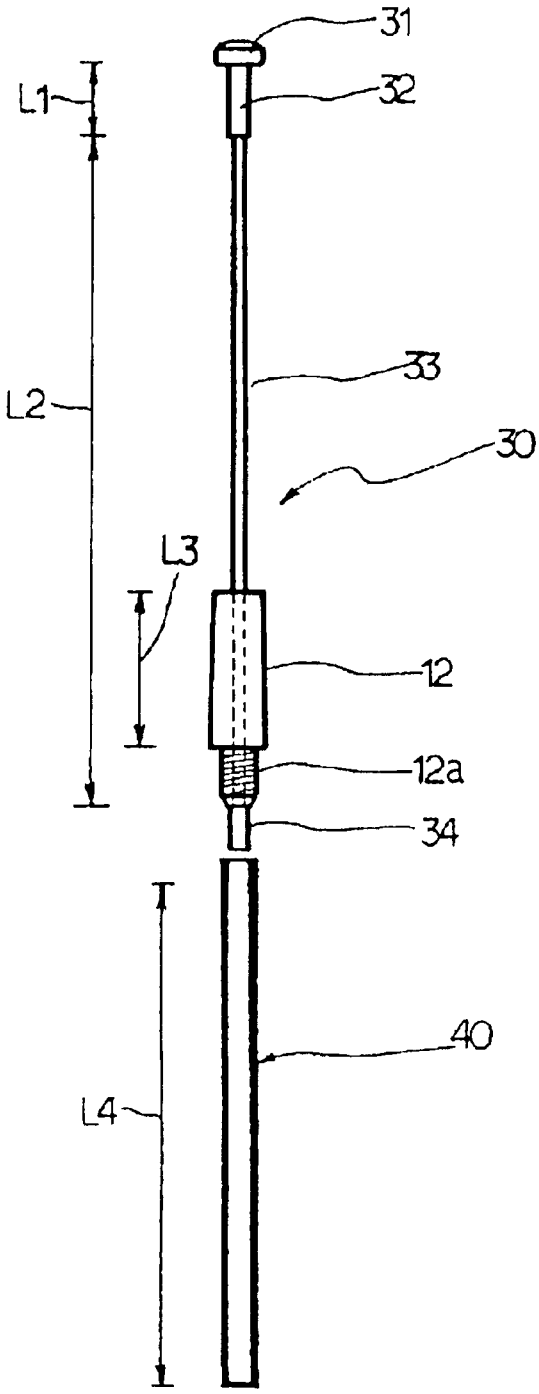
FIG. 6 illustrates a schematic diagram of a structure of the antenna unit according to a preferred embodiment of the present invention with its whip antenna fully extended.

Referring now to FIG. 5, the structure of an antenna unit according to a preferred embodiment of the present invention with its whip antenna 30 fully retracted will be explained. Further, referring to FIG. 6, the structure of the antenna unit with its whip antenna fully extended will be explained. The antenna unit of the present invention includes a helical antenna (shown in FIG. 8) disposed within an antenna housing 12 positioned onto a main body of the mobile terminal, a whip antenna 30 being retractable to or extendable from the antenna housing 12, and a conductive tube 40 receiving a rod antenna section 33 in a fully retracted position of the whip antenna. The helical antenna is placed within the antenna housing protruding from the main body in a fixed direction, and the whip antenna 30 is disposed retractably or extendably with respect to the antenna housing 12. The conductive tube 40 is disposed in a longitudinal direction on the main body and then grounded thereto.

With whip antenna 30 in the retracted position, the helical antenna mainly serves as an antenna of a mobile terminal, while the whip antenna 30 is in the extended position, the whip antenna 30 itself serves as a main antenna.

The whip antenna 30 includes an antenna cap 31 positioned in its uppermost end, a conductive stopper 34 positioned in its lower end, and a rod antenna 33 that functions as an antenna extending between the antenna cap 31 and the conductive stopper 34. An insulator 32 of a given length, downwardly extending from a bottom end of the antenna cap 31 in its longitudinal direction, is disposed in an upper part of the rod antenna 33.

The whip antenna 30 moves retractably or extendably with respect to the antenna housing 12, so that in the retracted position its almost entire body except for the antenna cap 31, inclusive of the rod antenna 33 and the stopper 34, is received by the conductive tube 40, while in the extended position the antenna cap 31, the insulator 32 and a part of the rod antenna 33 are exposed to the outside of the main body.

A lower end of the antenna housing 12 is provided with a metal coupling 12*a* adapted to screw onto the main body for attachment and detachment with respect to the main body. The metal coupling 12*a*, which is preferably formed in one body with the antenna housing 12, has in its periphery screwed teeth and is coupled with an antenna bushing (not shown).

The conductive tube 40 may consist of metal material, preferably of a metal tube. In the antenna unit according to a preferred embodiment of the present invention, the insulator 32 and an upper part of the rod antenna 33 are positioned within the helical antenna, when the whip antenna 30 is fully retracted into the conductive tube 40. A length of an antenna element that functions as an antenna section of the whip antenna 30 consists of a sum of a length L1 of the insulator 32 and a length L2 of the rod antenna 33, wherein the length L1 of the insulator 32 is designed to be shorter than a length L3 of the helical antenna. Further, the length L2 of the rod antenna 33 is formed to be longer than a length L4 of the conductive tube 40.

According to the foregoing structure, it is appreciated that a part of the rod antenna 33 is positioned within the helical antenna when the whip antenna 30 is fully retracted into the antenna housing 12. As a result, it reduces any disadvantageous effects due to the performance of radiation by the helical antenna, and the conductive tube 40 serves as a means of shield to noises caused by some harmonic components of digital clocks generated within a portable radiotelephone. Accordingly, it is possible for a mobile communications terminal to improve the performance of receiving and transmitting of radio signals.

Therefore, the conductive tube 40 according to the present invention makes it possible to reduce a length of the insulator 32 and instead of it, to increase a length of the rod antenna 33 as compared to the prior art.

Figure 7:
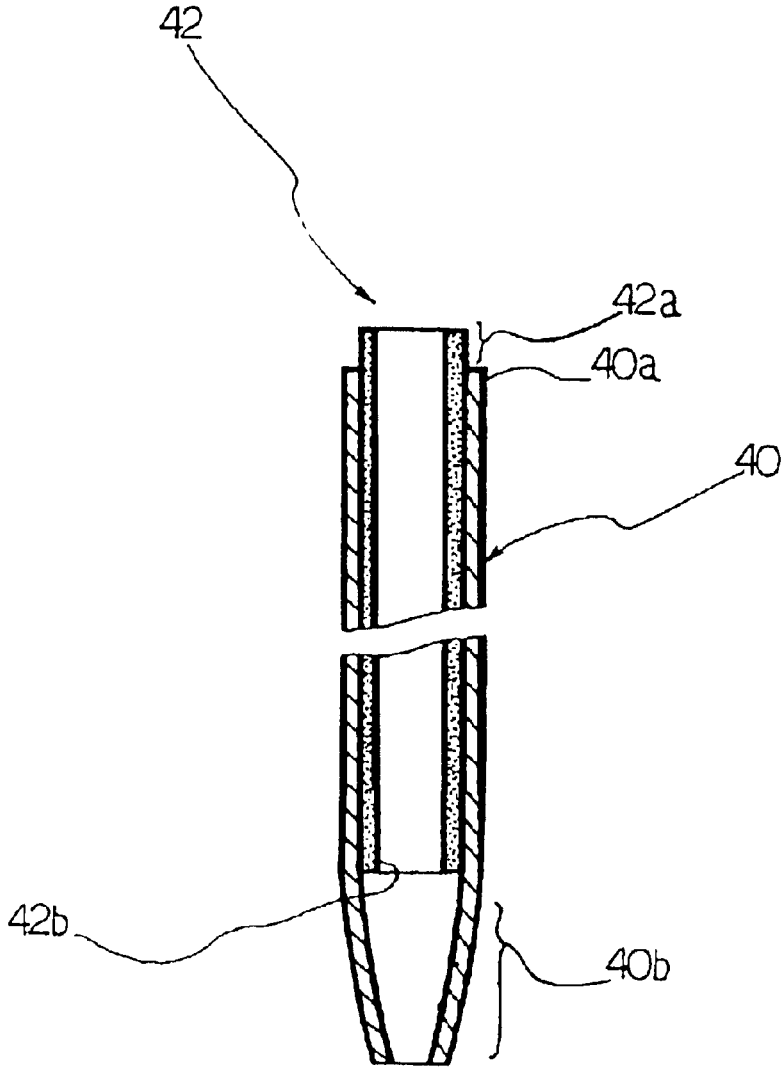
FIG. 7 illustrates a schematic diagram of a structure of a conductive tube according to a preferred embodiment of the present invention.

FIG. 7 illustrates a schematic diagram of structure of the conductive tube 40 according to a preferred embodiment of the present invention. The conductive tube 40 is preferably of a cylindrical tube disposed adjacent to a bottom surface of the main body and serves as a spacer for receiving the rod antenna and the stopper in the retracted position of the whip antenna. To make smooth sliding of the rod antenna within the conductive tube as well as efficiently reduce any frictional noises during movement between neighboring elements of the antenna rod, a plastic insulating tube 42 may be preferably provided to an inner surface of the conductive tube. The insulating tube 42 extends in the longitudinal direction within the conductive tube, while the inner surface of which contacts an outer surface of the insulating surface. Therefore, the rod antenna section, specifically, the stopper of the whip antenna, is smoothly retracted into or extended from the insulating tube 42 in its longitudinal direction.

Preferably, an upper end 42*a* of both ends 42*a* and 42*b* of the insulating tube 42 may be disposed in a position more upwardly protruding from an upper end 40*a* of the conductive tube 40, and the other end 42*b* of the insulating tube may be disposed in an even position with the other end 40*b* of the conductive tube, providing decreasing diameter toward the bottommost end of the conductive tube. The upper end 42*a* of the insulating tube serves to provide suitable insulation between the helical antenna and the conductive tube, and the other end 42*b* serves as a ground element to the stopper. The insulating tube 42 has an inner diameter larger than an outer diameter of the stopper.

Figure 8:
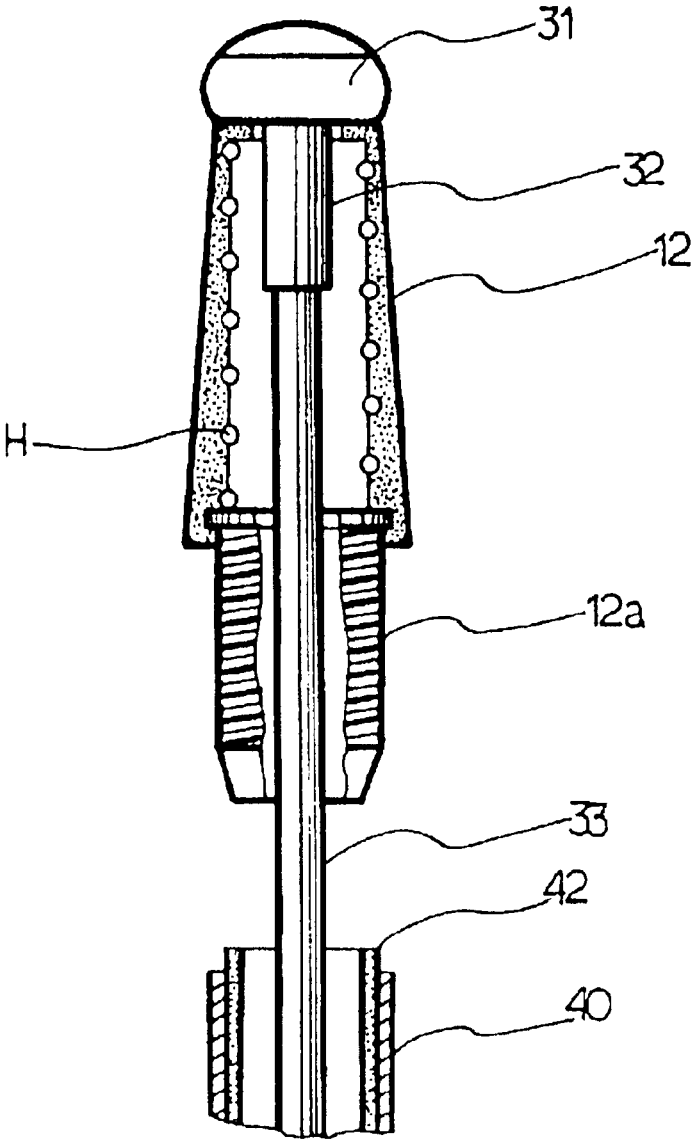
FIG. 8 illustrates a schematic diagram of a structure of the whip antenna retracted into the conductive tube according to a preferred embodiment of the present invention.

Referring now to FIG. 8, the structure of the whip antenna fully retracted to the insulating tube according to a preferred embodiment of the present invention is shown.

As apparent from the foregoing description, the antenna unit according to the present invention provides a helical antenna with improved performance by increasing the isolation characteristic between the helical antenna and the rod antenna section using a conductive tube, in the case where the whip antenna is fully retracted into the antenna housing. Further, in the case where the elongated rod antenna section is used in an extended position of the whip antenna, the inventive antenna unit provides mobile communication terminals with improved communication performance due to increased radiation efficiency of its antenna. Furthermore, it will considerably decrease the SAR (Specific Absorption Rate) due to dispersed current distribution upon radiation of the antenna.

While the preferred embodiments of the present invention have been illustrated and described, it will be understood by those skilled in the art that various changes and modifications may be made, and equivalents may be substituted for elements thereof without departing from the true scope of the present invention. Therefore, it is intended that the present invention not be limited to the particular embodiment disclosed as the best mode contemplated for carrying out the present invention. Instead, it is intended that the present invention include all embodiments falling within the scope of the appended claims.

What is claimed is:

1. An antenna unit for a mobile communications terminal, comprising:

an antenna housing extending from a main body of the mobile communications terminal, said antenna housing having therein a helical antenna;

a whip antenna disposed retractably and extendably with respect to said antenna housing, having at one end an insulator having a length shorter than a length of the helical antenna and at another end a rod antenna; and a conductive tube disposed in a longitudinal direction of the main body below the antenna housing, for receiving said rod antenna in the retracted and extended position of said whip antenna, whereby said insulator is positioned within said helical antenna when said whip antenna is fully retracted into said antenna housing.

2. An antenna unit according to claim 1, wherein said conductive tube is made of a metal component.

3. The antenna unit according to claim 1, wherein said conductive tube comprises on its inner surface an insulating tube for isolation from said whip antenna.

4. An antenna unit according to claim 3, wherein said insulating tube extends along said conductive tube.

5. An antenna unit according to claim 3, wherein one end of said insulating tube protrudes in the longitudinal direction from a corresponding one end of said conductive tube, and a diameter of the other end of said insulating tube is formed to downwardly decrease within a corresponding other end of said conductive tube.

6. An antenna unit according to claim 3, wherein a length of said rod antenna is longer than a length of said insulating tube.

7. An antenna unit according to claim 1, wherein said conductive tube is grounded to the main body.

* * * * *